US010842267B2

(12) United States Patent
Rihtarec et al.

(10) Patent No.: US 10,842,267 B2
(45) Date of Patent: Nov. 24, 2020

(54) MOVEMENT MECHANISM FOR A GUIDANCE SYSTEM

(71) Applicant: Grass GmbH, Hoechst (AT)

(72) Inventors: Filip Rihtarec, Fussach (AT); Juergen Nachbaur, Hohenems (AT); Joseph Kruijen, Goetzis (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 16/207,707

(22) Filed: Dec. 3, 2018

(65) Prior Publication Data

US 2019/0166995 A1 Jun. 6, 2019

(30) Foreign Application Priority Data

Dec. 4, 2017 (DE) ..... 10 2017 128 747

(51) Int. Cl.

| | |
|---|---|
| ***A47B 88/427*** | (2017.01) |
| ***A47B 88/477*** | (2017.01) |
| ***A47B 88/483*** | (2017.01) |
| ***A47B 88/493*** | (2017.01) |
| *A47B 88/463* | (2017.01) |
| *A47B 88/467* | (2017.01) |

(52) U.S. Cl.

CPC ..... *A47B 88/427* (2017.01); *A47B 88/477* (2017.01); *A47B 88/483* (2017.01); *A47B 88/493* (2017.01); *A47B 88/463* (2017.01); *A47B 88/467* (2017.01); *A47B 2210/0059* (2013.01)

(58) Field of Classification Search

CPC ..... A47B 88/47; A47B 88/427; A47B 88/463; A47B 88/467; A47B 88/477; A47B 88/483; A47B 88/493

USPC ..... 312/330.1, 333, 319.1, 334.1, 334.7

See application file for complete search history.

(56) References Cited

U.S. PATENT DOCUMENTS

| | | | | |
|---|---|---|---|---|
| 7,472,973 | B2 * | 1/2009 | Huang | A47B 88/467 312/319.1 |
| 8,109,582 | B2 | 2/2012 | Dubach | |
| 2014/0001938 | A1 * | 1/2014 | Migli | E05C 19/022 312/319.1 |

(Continued)

FOREIGN PATENT DOCUMENTS

| | | |
|---|---|---|
| DE | 20 2012 003 537 U1 | 9/2003 |
| DE | 10 2010 036 902 A1 | 2/2011 |
| EP | 1 921 948 B1 | 2/2014 |

OTHER PUBLICATIONS

German Search Report (Application No. 10 2017 128 747.7) dated Oct. 16, 2018.

*Primary Examiner* — James O Hansen

(74) *Attorney, Agent, or Firm* — Burr & Brown, PLLC

(57) ABSTRACT

A movement mechanism for a guidance system, especially for a linear guidance system, wherein the movement mechanism comprises a base housing, wherein the base housing has attachment means for mounting the movement mechanism on a body rail of the guidance system, wherein the base housing comprises installing means for mounting an ejector and/or a force accumulator of the movement mechanism. The movement mechanism is characterized in that an attachment member of the attachment means is present on the base housing such that the movement mechanism can be mounted on a body rail of a left or a right guidance system for a push element.

17 Claims, 7 Drawing Sheets

(56) References Cited

U.S. PATENT DOCUMENTS

| | | | | |
|---|---|---|---|---|
| 2014/0021841 | A1* | 1/2014 | Brunnmayr | A47B 88/57 312/319.1 |
| 2014/0327351 | A1* | 11/2014 | Chung | A47B 88/463 312/333 |
| 2014/0363107 | A1* | 12/2014 | Egger | F16C 29/02 384/21 |
| 2015/0108891 | A1* | 4/2015 | Brunnmayr | A47B 96/00 312/319.8 |
| 2017/0273456 | A1* | 9/2017 | Davis | A47B 88/47 |

* cited by examiner

MOVEMENT MECHANISM FOR A GUIDANCE SYSTEM

This application claims the benefit under 35 USC § 119(a)-(d) of German Application No. 10 2017 128 747.7 filed Dec. 4, 2017, the entirety of which is incorporated herein by reference.

FIELD OF THE INVENTION

The present invention relates to a movement mechanism for a guidance system.

BACKGROUND OF THE INVENTION

A movement mechanism for a guidance system, especially for a push element, such as for a push element of furniture or a household or kitchen appliance, is known in various designs.

For example, so-called partial extensions or full extensions with mutually telescopic guide rails are in use as guidance systems. These guide rails are mounted movable to each other by means of a movement mechanism.

Generally a push element such as a drawer, a shelf, a cooking product carrier or the like is movably received by precisely two separate but identical structural units of a partial extension or a full extension. The mounting is done preferably secured on inner sides of a furniture body or a housing of a household or kitchen appliance.

Since a movement mechanism for a guidance system must stand up to high technical and economical demands, further optimizations in this regard are necessary for the existing solutions.

SUMMARY OF THE INVENTION

The problem which the present invention proposes to solve is to further improve the aforementioned movement mechanism for a guidance system, especially in terms of a relatively simple mounting on the guidance system with economical manufacture and/or use at the same time.

The present invention starts from a movement mechanism for a guidance system, especially for a linear guidance system, wherein the movement mechanism comprises a base housing, wherein the base housing has attachment means for mounting the movement mechanism on a body rail of the guidance system, wherein the base housing comprises installing means for mounting an ejector and/or a force accumulator of the movement mechanism.

For example, the guidance system is designed for mounting on a piece of furniture or on a household appliance, such as a kitchen appliance, e.g., as a furniture guidance system or as a household appliance guidance system. In the following, an orientation of the guide rail in the condition of use or the installed condition of the guidance system on a piece of furniture or on a household appliance, such as a kitchen appliance, shall be assumed.

The guidance system comprises, for example, a guide rail, a body rail and a carriage. For example, the guidance system is designed as a partial extension or as a full extension. In the mounted condition of the guidance system, the carriage is arranged, e.g., between the body rail and the guide rail, so that the guide rail is mounted by the carriage movably relative to the body rail. A partial extension comprises one body rail and one guide rail in the form of a push element rail. A full extension comprises one body rail and guide rails in the form of a center rail and a push element rail.

The crux of the present invention is to be seen in that an attachment member of the attachment means is present on the base housing such that the movement mechanism can be mounted on a body rail of a left or a right guidance system for a push element. In this way, the movement mechanism can be arranged on both a left and a right guidance system of a push element of the furniture or the household appliance, e.g., a drawer. It is also conceivable that the movement mechanism can be arranged on the push element rail.

Furthermore, this reduces the number of different components of the movement mechanism and the movement mechanism can be manufactured relatively economically. Advantageously, a base housing of the movement mechanism is present both on the left and the right guidance system in the mounted condition on the furniture or on the household appliance and the two base housings are identical.

The attachment member is designed, in particular, so that a mirror-symmetric mounting of the movement mechanism can be realized on a body rail of a left and/or a right guidance system of a push element.

The base housing is advantageously present as a, for example, cuboidal oblong housing element with two side walls and two end faces. The two end faces are mutually opposite and spaced apart on the base housing and they extend advantageously perpendicular to a lengthwise axis of the base housing. The side walls of the base housing extend advantageously parallel to a lengthwise axis of the base housing and are provided mutually opposite and spaced apart on the base housing. The lengthwise axis of the movement mechanism, and especially that of the base housing, extends in the mounted condition of the movement mechanism on the guidance system advantageously parallel to a longitudinal extension of the guidance system, especially parallel to a direction of movement, especially to the guide rail of the guidance system. The length of the base housing is advantageously longer than half the length of the body rail of the guidance system on which the movement mechanism can be mounted. The base housing is configured to be framelike, e.g., in the shape of a frame.

It is further proposed that the attachment member is configured in mirror symmetry. Advantageously, the attachment member is present in mirror symmetry along the lengthwise axis of the base housing and/or transversely to the lengthwise axis of the base housing.

It likewise proves to be of advantage for the base housing to be configured as an oblong housing element and wherein side walls of the base housing are present in mirror symmetry about a lengthwise axis of the base housing. Advantageously, one side wall of the housing element in the mounted condition on the guidance system extends along a lengthwise axis of the guidance system. For example, one side wall of the housing element extends along a side wall length which corresponds to more than a third of the length of the body rail of the guidance system. Preferably, the base housing is formed substantially in mirror symmetry, in particular.

Furthermore, it is of advantage for two attachment members of the attachment means to be present on opposite ends of the base housing, especially ends which are spaced apart, in order to secure the movement mechanism by the attachment members to the body rail of the guidance system. In this way, a rotatably firm mounting of the movement mechanism on the guidance system can be realized.

The attachment member is advantageously connected to the base housing as a single piece. For example, the attachment member is integrated in the base housing. It is also conceivable for the attachment member to be configured as a separate element from the base housing and to be mountable on the base housing.

It likewise proves to be of advantage for one attachment member to be designed as a snap element in order to snap or clip the base housing on an attachment element of the body rail. This realizes a comparatively simple mounting of the movement mechanism on the guidance system. The snap element is formed as a snap hook, for example. The attachment element of the guidance system is present in the form of a bolt, for example.

It is also advantageous for the movement mechanism to comprise a housing cap, in addition to the base housing. Advantageously, the installing means of the base housing are designed to secure the housing cap on the base housing. This improves the outer appearance of the movement mechanism. The housing cap in the mounted condition on the base housing, for example, protects a force accumulator of the movement mechanism against external influences, such as dust or dirt.

Furthermore, it is of advantage for the movement mechanism to comprise an ejector and for the ejector to comprise a coupling member with which the ejector can be coupled to a driver of a guide rail and wherein the coupling member of the ejector is configured in mirror symmetry. In this way, the ejector is configured to work with both a driver of the guide rail of a left and/or a right guidance system of a push element, depending on the mounting of the movement mechanism.

For example, the ejector is designed as a slider or a sliding element or a pawl. Besides the base housing and the ejector, the movement mechanism also advantageously comprises a force accumulator. The force accumulator is present in particular as a force accumulator able to move in linear fashion. The force accumulator, for example, comprises a spring, such as a spring pack. Furthermore, it is conceivable for the force accumulator to comprise, in particular, an additional damping member, e.g., in order to dampen the movement of the ejector in the pulling direction of the spring of the force accumulator. The damping member is a hydraulic damping member, for example. It is also conceivable for the damping member to be elastic. For example, the damping member is present as an elastic element, such as a rubber or a plastic damper.

In one advantageous modification of the movement mechanism, side walls of the base housing, especially one side wall section of one side wall of the base housing, are formed elastically on the base housing in order to snap the ejector onto the base housing. For example, one side wall section of a side wall of the base housing is offset inward transversely to a longitudinal extension of the base housing, so that in the mounted condition of the movement mechanism on the guidance system the side wall section has a spacing from the body rail of the guidance system. For example, the side wall of the base housing rests against the body rail in the mounted condition on the guidance system, especially for the side wall section. For example, the ejector can be pushed onto the base housing in a movement from above, transversely to the lengthwise axis of the base housing.

It is further proposed that one side wall of the base housing has guide means in order to guide the ejector, especially in linear motion. For example, the ejector is guided solely in linear movement on the base housing.

A guide means is present, for example, as a guide path or as a guide contour. Advantageously, each side wall comprises a guide path. Preferably, the ejector is movably mounted on the side wall section, for example, it is movably guided.

Furthermore, it is of advantage for the ejector and the base housing to be configured and the ejector to be arranged on the base housing such that, in the mounted condition of the movement mechanism on the guidance system, a driver of the guidance system runs across the ejector at least partly in a closing movement of the guidance system in order to couple with the ejector.

Advantageously, the ejector is configured and arranged on the base housing such that the ejector catches or releases the driver of the guidance system in an opening and/or closing movement of the guidance system by a swivel movement, a swivel axis of the swivel movement being present perpendicular to a lengthwise axis and parallel to a normal to a side wall of the base housing. Preferably, the swivel axis is present parallel to a normal to an outer side of the side wall, which rests against the body rail in the mounted condition.

It is also proposed that a holding means is present and/or can be mounted at one end face and/or on one side wall of the base housing in the form of a holding member in order to mount an additional ejecting and/or retracting unit, such as a further movement mechanism, on the movement mechanism.

The holding member is advantageously designed in the form of a member of a coupling, e.g., a plug-in coupling. In particular, the holding member is present as a plug or a socket of the coupling. For example, one holding member is present at each end face of the base housing. In particular, the holding members of the two end faces of the base housing are fashioned complementary to each other. Preferably, the holding member can be mounted at the attachment means, especially in the mounted condition of the movement mechanism on the body rail. For example, the attachment means encompass the holding member, in particular, the holding member is present as attachment means.

It is furthermore of advantage for the ejector to comprise connection means in order to connect a force accumulator of the movement mechanism to the ejector.

The connection means are advantageously provided such that both a T-shaped and/or an L-shaped connection member of the force accumulator can be connected to the ejector. For example, the connection members can be clipped and/or pushed onto the connection means.

It is also of advantage for the movement mechanism to be designed as an automatic retractor and/or as a touch latch unit and/or as an ejecting unit.

Advantageously, the movement mechanism is provided in mirror symmetry about a lengthwise axis of the base housing. In particular, the automatic retractor and/or the touch-latch unit and/or the ejecting unit are present in mirror symmetry about a lengthwise axis of the base housing together with the base housing and the components mounted on the base housing, such as the ejector, the force accumulator and/or the housing cap.

In one advantageous modification of the movement mechanism, the base housing, especially the side walls of the base housing, are elastically configured so that in the mounted condition of the base housing on the guidance system a self-healing of the coupling of the ejector with a driver of the guidance system can be realized in that the base housing and/or one side wall of the base housing is bendable perpendicular to the lengthwise axis, e.g., to the longitudinal extension of the base housing. For example, the side wall section of the side wall of the base housing is bendable, so that a self-healing of the coupling of the ejector with the driver can be realized. Advantageously, each side wall of the base housing extending in the longitudinal extension of the base housing comprises a side wall section. The two side wall sections are present, for example, in mirror symmetry to each other, especially situated opposite each other on the base housing. Advantageously, the ejector can move together with the two side wall sections perpendicular to the longitudinal extension.

Advantageously, a driver in the decoupled condition from the ejector displaces and/or presses the ejector and with the ejector the base housing, for example, a side wall, especially the side wall section, in an opening and/or closing movement of the guidance system in a direction perpendicular to the longitudinal extension of the base housing, the ejector being in a closed and therefore, for example, unloaded condition on the base housing, so that a coupling of the driver with the ejector can be realized.

One advantageous embodiment of the invention is a guidance system with a movement mechanism according to one of the preceding variants. A push element guide unit with two guidance systems is also proposed. Furthermore, a piece of furniture is of advantage with a movement mechanism and/or a guidance system according to one of the preceding variants. Also of advantage is a household appliance with a movement mechanism and/or a guidance system according to one of the preceding variants.

BRIEF DESCRIPTION OF THE DRAWINGS

Further features and benefits of the invention are explained in more detail with the aid of the exemplary embodiments of the invention as represented in the figures.

DETAILED DESCRIPTION OF THE INVENTION

In part, the same reference numbers are used below for corresponding elements of different exemplary embodiments.

Figure 1:
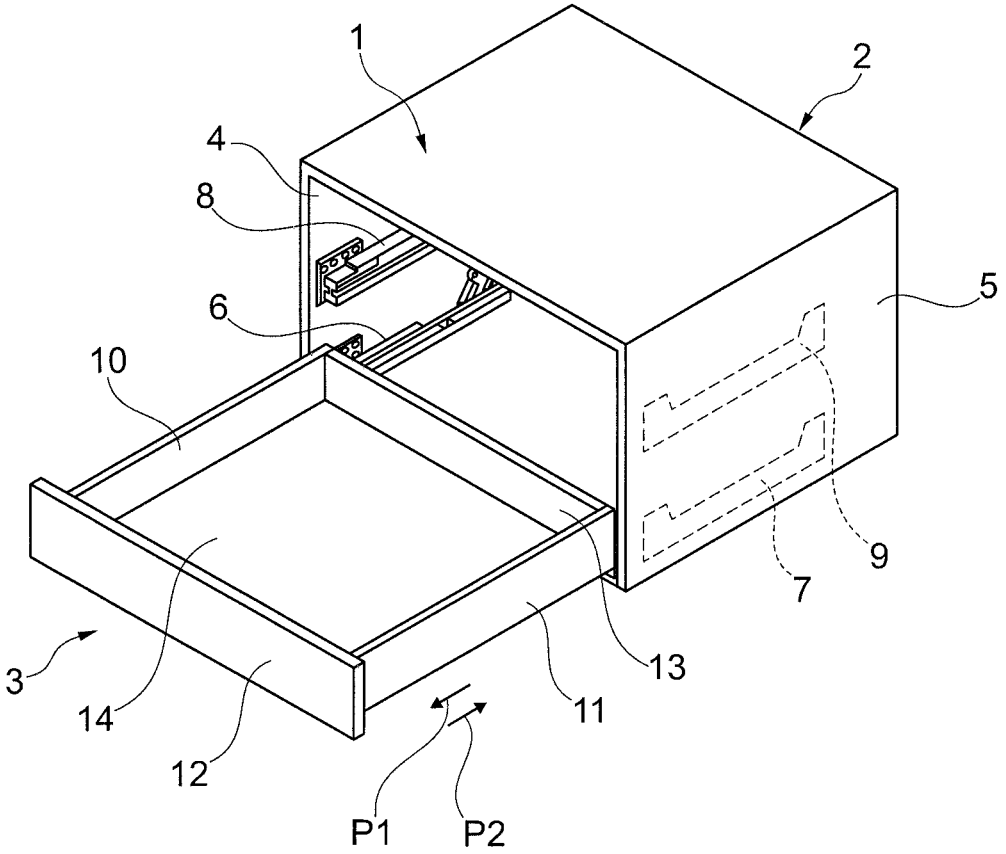
FIG. 1 is a schematically represented piece of furniture according to the present invention in perspective view slanting from above with a drawer displaceably received on it.

FIG. 1 shows highly schematized a piece of furniture 1 according to the present invention in a condition of use with a hollow cuboidal furniture body 2 and a push element fashioned as a drawer 3, wherein the drawer 3 is received displaceably on the furniture body 2. The furniture body 2 comprises two opposite vertical side walls 4 and 5, between which the drawer 3 can be pulled out in the horizontal direction from the furniture body 2 per P1 from a condition accommodated in the interior of the furniture body 2 via a guidance system according to the invention with telescopic guiding means, e.g. in a subfloor design, or a first rail full extension 6 and a second rail full extension 7, and can be pushed into the body in the opposite direction per P2. In FIG. 1, the drawer 3 is shown in the condition moved out to the utmost or entirely from the interior of the furniture body 2. Hence, the storage volume of the drawer 3 is accessible from above with almost no hindrance.

If the drawer 3 uses in each case a rail partial extension instead of the rail full extension 6, 7, the drawer 3 in the maximum pulled-out condition cannot be moved so far out from the interior of the furniture body 2 in the direction P1, as is possible with the rail full extension 6, 7 per the representation in FIG. 1. The front element 12 is then closer to the open front side of the furniture body 2 than is shown in the drawer 3 of FIG. 1.

The rail full extension 6 fastened to the side wall 4 on the inside is located opposite at the same vertical height as the rail full extension 7 fastened to the side wall 5 and hidden from view in FIG. 1, being indicated by broken lines.

A further drawer correspondingly guided by rail full extension 8 and 9 can be accommodated in the furniture body 2 above the drawer 3, not being shown in FIG. 1.

The drawer 3 comprises oppositely situated drawer side walls 10, 11, each comprising a constructed hollow chamber frame. Furthermore, the drawer 3 comprises a front element 12, a rear wall 13 situated opposite to it in the horizontal direction, and a horizontally extending drawer bottom 14, which reaches as far as the drawer side walls 10, 11, the front element 12 and the rear wall 13 or is joined to them.

Figure 2:
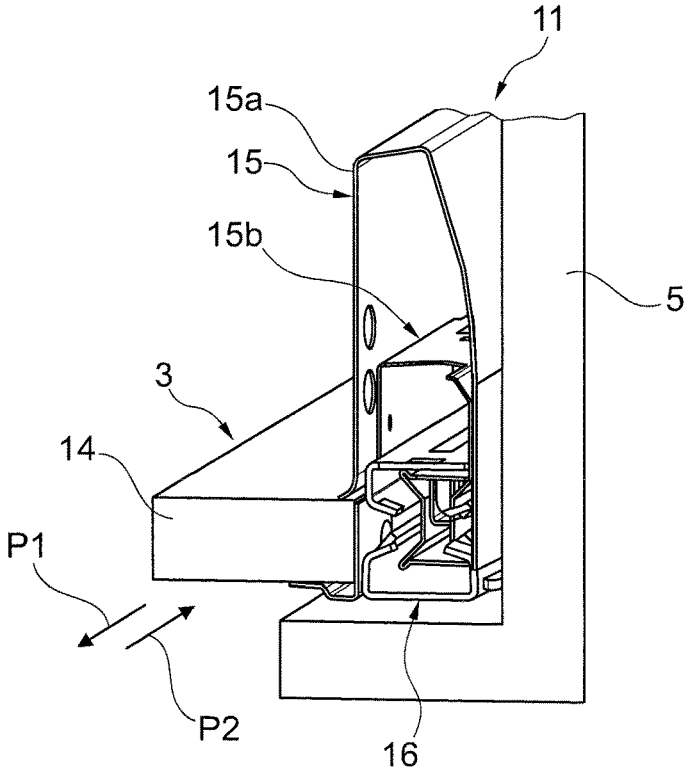
FIG. 2 is in cross section, a perspective cutout view of a piece of furniture according to the present invention in the region of a drawer side, adjacent to a furniture body wall and a furniture body bottom.
Figure 3:
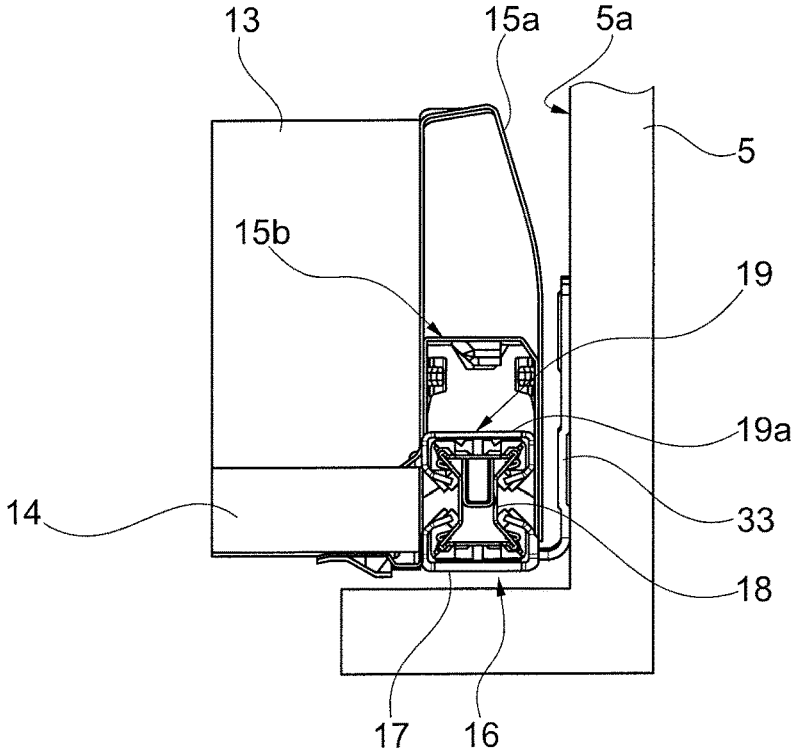
FIG. 3 is the cutout of FIG. 2 in a front view.
Figure 4:
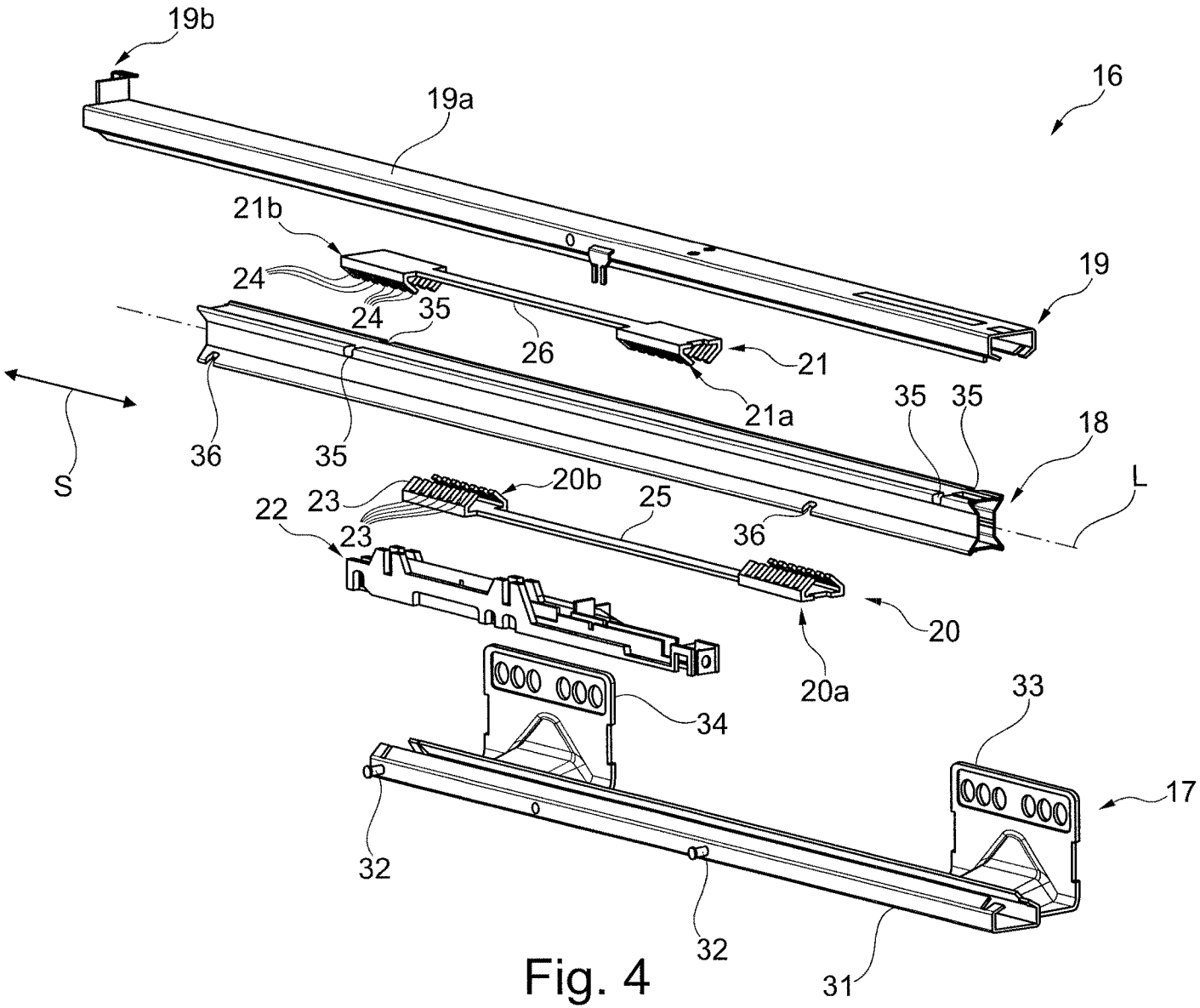
FIG. 4 is an exploded view of a structural unit of a guidance system according to the present invention, with a movement mechanism according to the present invention.

FIGS. 2 and 3 show, in the area of a body side wall 5, a cut-out of a drawer 3, which in this embodiment comprises, for example, hollow chamber frames, with a drawer bottom 14 and a drawer side wall 11 and a rear wall 13 configured as a hollow chamber frame 15. The drawer 3 is received by two structural units of a guidance system according to the invention on the furniture body 2 or by a rail full extension 16 according to the invention on the side wall 5 and in the same manner by a further hollow chamber frame of the drawer 3 on the side wall 4 not visible in FIG. 2. It is received on the side wall 4 by a further structural unit or a further full extension according to the present invention, by which the drawer 3 can move in a linear horizontal manner in the directions P1 and P2.

The hollow chamber frame 15 made preferably from a bent sheet metal material has an external housing 15*a* and an internal structure 15*b*, so that the full extension 16 can be recessed into the internal volume of the hollow chamber frame 15. At an inner side of the hollow chamber frame 15, it is configured to receive a lengthwise edge of the drawer bottom 14 in its lower segment.

The full extension 16 formed as a structural unit of the guidance system comprises three mutually telescopic guide rails or a body rail 17, a center rail 18 and a push element rail 19.

The center rail 18 is configured as a hollow profile.

A movable push element such as the drawer 3 is coupled or connected to the push element rail 19, for example, it is secured to the hollow chamber frame 15, whereas the body rail 17 is connected to the stationary part of the furniture 1. If the full extension 16 is being used as a subfloor guide, a bottom side of a push element or its bottom will be braced against a top side 19*a* of the push element rail 19. A hook element 19*b* protruding upward at the rear end of the push element rail 19 forms an end stop for a segment of a rear outer side of the push element, and for the exact positioning an angled segment of the hook element 19*b* parallel to the top side 19*a* engages with a suitably provided recess in the rear outer side of the push element.

Furthermore, the full extension 16 comprises a first or lower carriage 20 with bearing bodies 23 arranged on it, the carriage 20 acting between the body rail 17 and the center rail 18 for a load-transmitting relative movement of the rails 17, 18.

Moreover, the full extension 16 comprises a second or upper carriage 21 with bearing bodies 24 arranged on it, the carriage 21 acting between the center rail 18 and the push element rail 19 for a load-transmitting relative movement of the rails 18, 19.

The carriages 20 and 21 comprise, for example, two running cages 20*a*, 20*b* or 21*a*, 21*b* and a connection element 25 or 26.

Attachment elements in the form of pins 32 are present on a vertically positioned, inwardly pointing narrow side of a rail body 31 of the body rail 17, by which a movement mechanism 22 of the full extension 16 can be attached, for example, for the ejecting and/or retracting of the drawer 3.

The body rail 17 includes two L-shaped fastening elements 33 and 34, the fastening elements 33 and 34 serving for the fastening or securing of the full extension to an inner side of the side wall of a body, such as the side wall 5 of the furniture body 2 of the furniture 1.

The guide rails 17, 18, 19 preferably consist of a sheet metal material, which is formed into the end product of the respective guide rail from the flat sheet metal material, for example, by a stamping and bending process.

Figure 5:
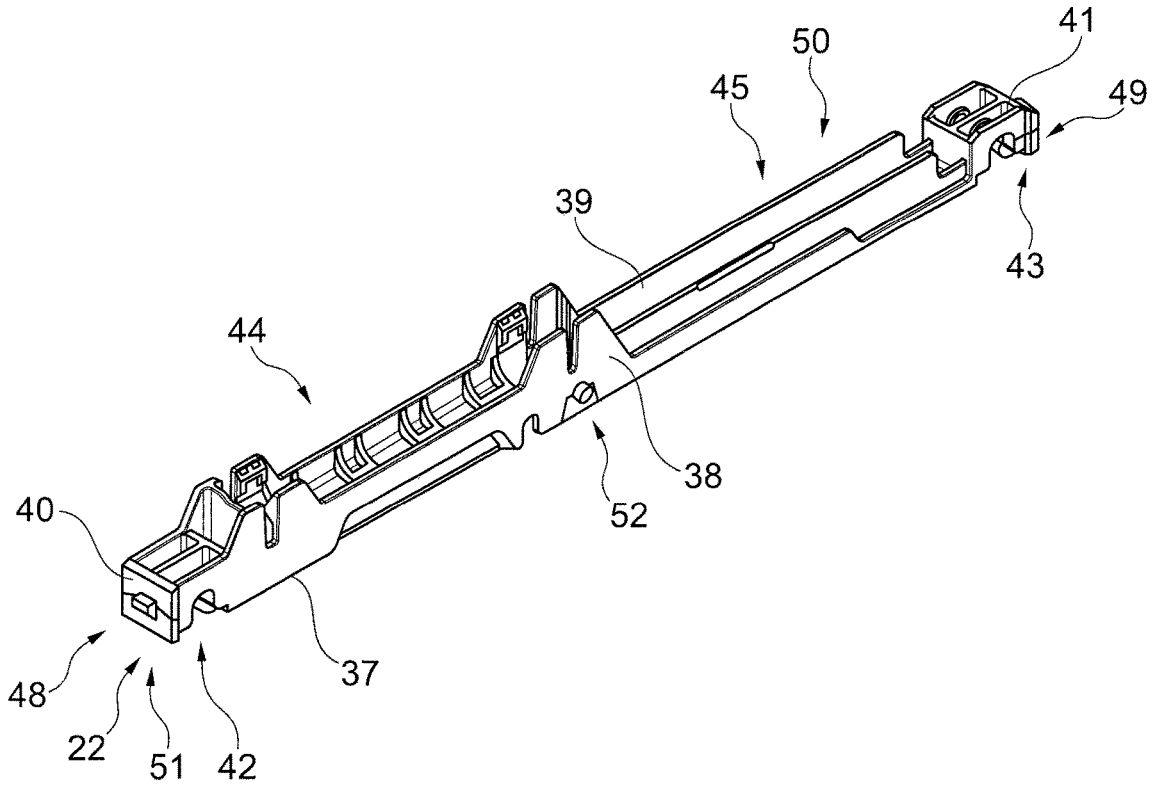
FIG. 5 is a perspective representation of a base housing of the movement mechanism of FIG. 4.

FIG. 5 shows a base housing 37 of the movement mechanism 22. The base housing 37 is fashioned as an oblong, especially a framelike housing. The base housing 37 has side walls 38, 39 and end faces 40, 41. Advantageously, the side walls 38, 39 and the end faces 40, 41 form a frame. The base housing 37 further comprises attachment means 42, 43 for the mounting of the base housing 37 on a guide rail, such as the body rail 17. The attachment means 42, 43 are advantageously provided at a rear end 48 and/or at a front end 49 of the base housing 37, especially spaced apart from each other. Furthermore, the base housing 37 comprises installing means 44, 45 for mounting an ejector 46 and for the installing of a force accumulator 47 (see FIG. 7). In the examples of the movement mechanism 22 shown in the figures, the movement mechanism is shown as an automatic retractor, so that the ejector 49 has the function of a driver element in the closing direction and not that of an ejector element in the opening direction.

The side walls 38, 39 are advantageously elastic at least for a portion, for example, along a front half 50 of the base housing 37. For example, the side walls 38, 39 are so elastic that they are movable or bendable transversely to their longitudinal extension.

Figure 6:
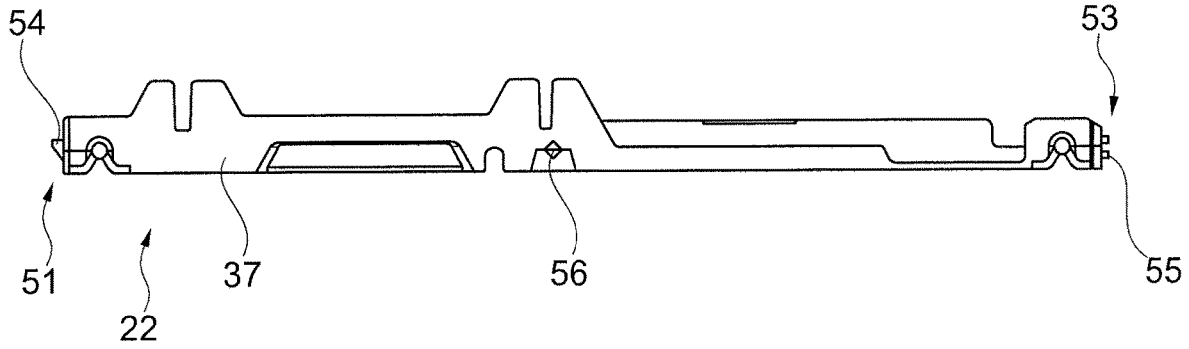
FIG. 6 is a side representation of the base housing of FIG. 5.

Furthermore, holding means 51-53 are provided on the base housing 37 in order to mount a further base housing on the base housing 37, especially one identical to the base housing 37 (FIG. 6). For example, the holding means 51-53 are configured as holding members 54, 55 and arranged sticking out at the end faces 40, 41 of the base housing 37. The holding members 54, 55 are advantageously complementary, for example, provided as a socket (holding member 55) and a plug (holding member 54). Furthermore, it is advantageous for one holding member 56 to be designed protruding outward on the side walls 38, 39 (holding member not shown on side wall 39).

Figure 7:
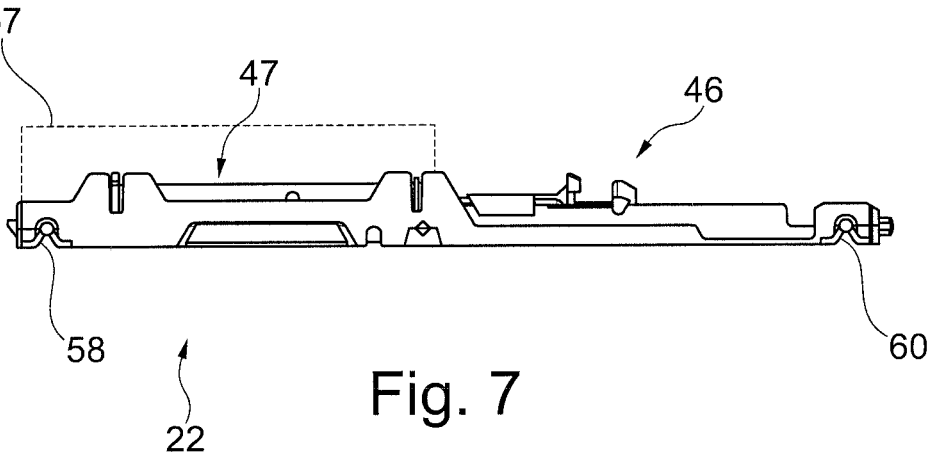
FIG. 7 is a side representation of the movement mechanism of FIG. 4.

FIG. 7 shows the base housing 37 with mounted force accumulator 47 and clipped-on ejector 46. Furthermore, a housing cap 57 is shown by broken lines in FIG. 7.

Figure 8:
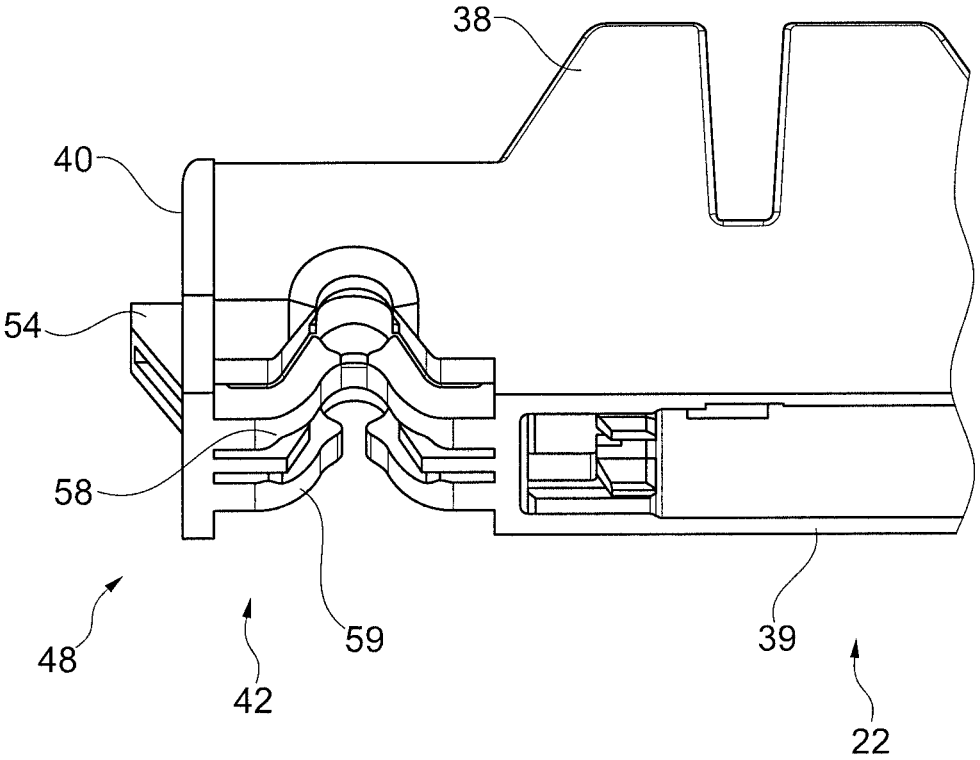
FIG. 8 is a perspective detail view slanting from below of a rear end of the movement mechanism of FIG. 4.

The partial view sloping from below in FIG. 8 and the side view in FIG. 7 show that the attachment means 42, 43 comprise attachment members 58, 59, 60. One attachment member 58-60 is advantageously designed in mirror symmetry, especially transversely to a longitudinal extension of the base housing 37. For example, one attachment member 58-60 is designed as a bracket or a clamp, so that the base housing 37 can be mounted by this attachment member 58-60, in particular, from above on an attachment element of the body rail 17, e.g., on the pins 32 of the rail body 31 of the body rail 17.

Figure 9:
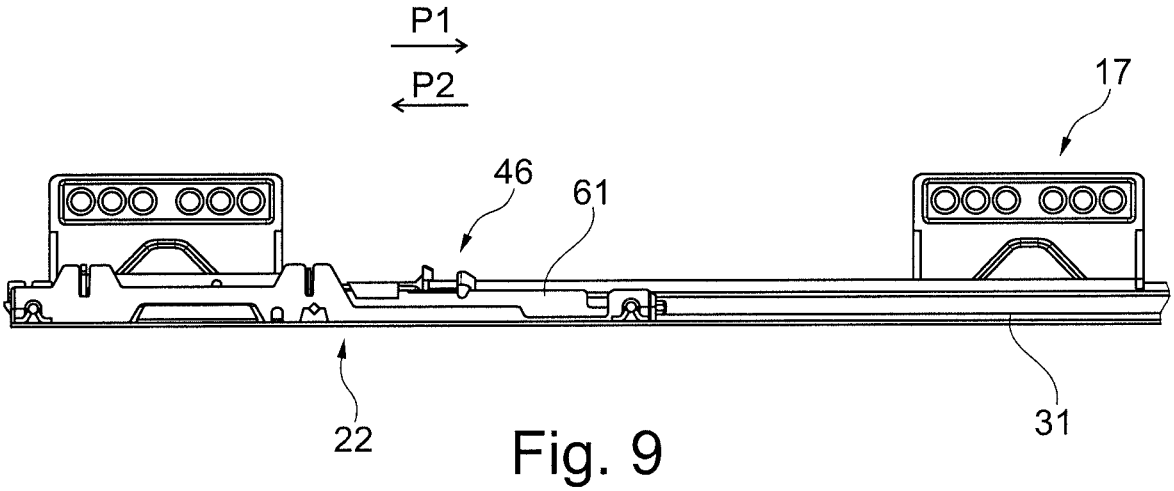
FIG. 9 is a side view of the movement mechanism in the mounted condition on a body rail of the guidance system.
Figure 10:
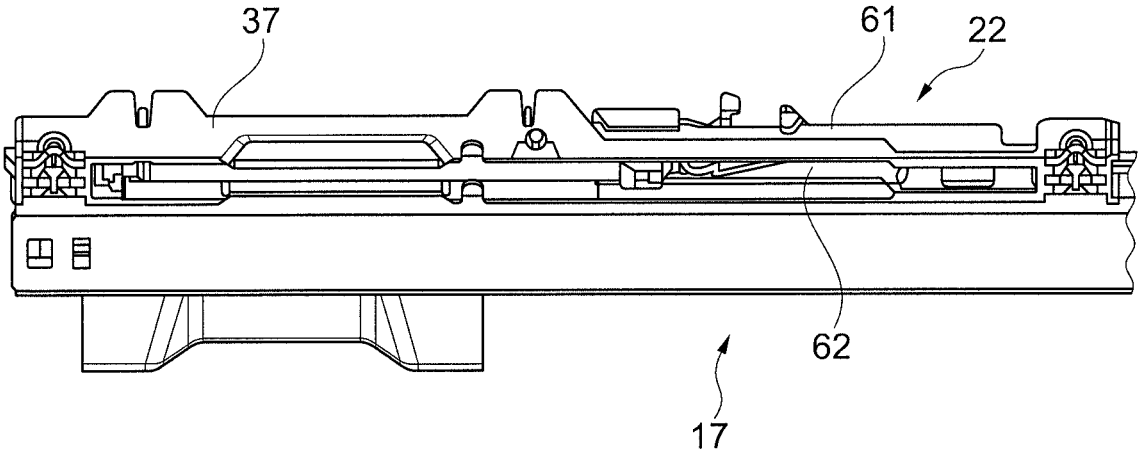
FIG. 10 is a perspective partial view slanting from below of the movement mechanism of FIG. 10 mounted on the body rail.

FIGS. 9 and 10 represent the movement mechanism 22 in the mounted condition on the body rail 17. The ejector 46 of the movement mechanism 22 is guided in particular in linear movement by guide means 61, 62, which are configured on side walls 38, 39 of the base housing 37, in the opening direction P1 and in the closing direction P2 of the full extension 16.

Figure 11:
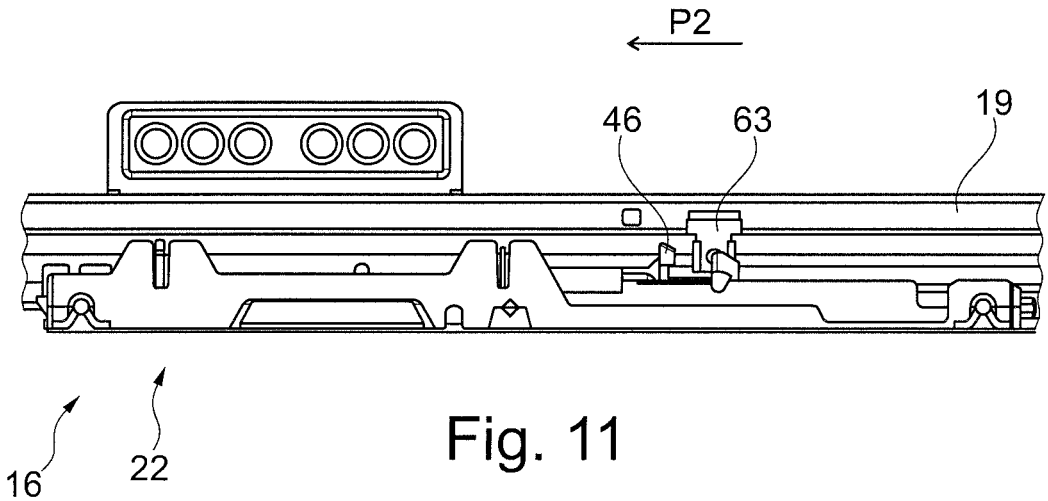
FIGS. 11 and 12 a side view of the movement mechanism in the mounted condition on the guidance system, in various positions of an ejector of the movement mechanism.
Figure 12:
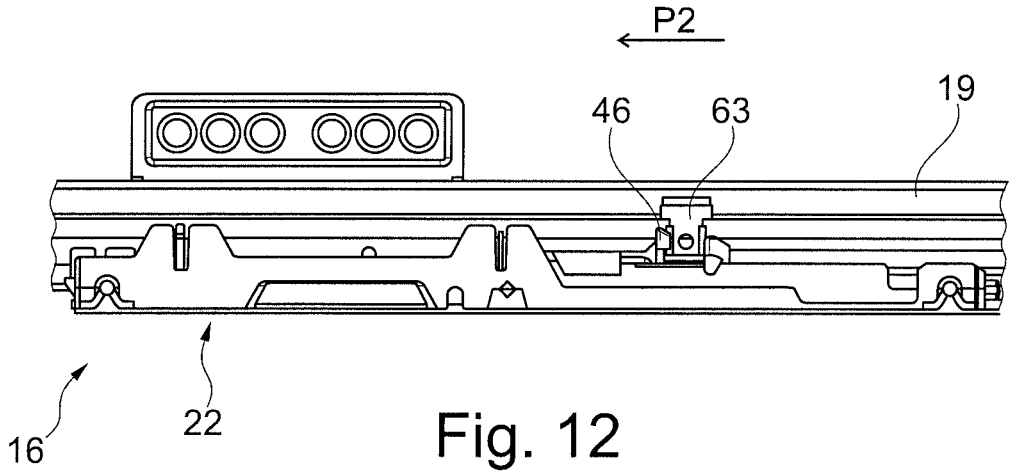

The ejector 46 is advantageously mounted movably on the base housing 37 by the elastic side walls 38, 39 such that a self-healing of a coupling of a driver 63 of the full extension 16 with the movement mechanism 22 can be realized. For example, the ejector 46 is in a closed position on the base housing 37 corresponding to FIGS. 11 and 12, while in the closed position the force accumulator 47 is, for example, at least for the most part without load. If the ejector 46 in this condition is decoupled from the driver 63, for example, (not shown), a restoring of the coupling of the ejector 46 with the driver 63 can be realized in this position, in particular, by moving the driver 63 in the direction P2 toward the ejector 46, whereupon the driver 63 making contact with the ejector 46 displaces the ejector 46 transversely to a longitudinal extension of the base housing 37, so that the driver 63 can move in the direction P2 into a coupled position corresponding to FIG. 12 with the ejector 46. In the example shown in FIG. 11, the ejector 46 is displaced by the driver 63 in the direction of the observer.

LIST OF REFERENCE NUMBERS

1 Furniture
2 Furniture body
3 Drawer
4-5 Side wall
6-9 Rail full extension
10-11 Drawer side wall
12 Front element
13 Rear wall
14 Drawer bottom
15 Hollow chamber frame
15*a* Housing
15*b* Internal structure
16 Full extension
17 Body rail
18 Center rail
19 Push element rail
19*a* Top side
19*b* Hook element

20 Carriage
20*a*-20*b* Running cage
21 Carriage
21*a*-21*b* Running cage
22 Movement mechanism
23-24 Bearing body
25-26 Connection element
31 Rail body
32 Pin
33-34 Fastening element
35-36 End stop
37 Base housing
38, 39 Side wall
40, 41 End face
42, 43 Attachment means
44, 45 Installing means
46 Ejector
47 Force accumulator
48, 49 End
50 Half
51-53 Holding means
54, 55 Holding member
56 Holding member
57 Housing cap
58-60 Attachment member
61, 62 Guide means
63 Driver

The invention claimed is:

1. A movement mechanism for a guidance system, the guidance system comprises a body rail and the movement mechanism comprises a base housing, wherein the base housing has attachment means configured to mount the movement mechanism on the body rail of the guidance system, wherein the base housing comprises installing means for mounting an ejector and/or a force accumulator on the movement mechanism, wherein at least one attachment member of the attachment means is present on the base housing, with the at least one attachment member configured as a snap element that is formed as a snap book in order to snap or clip the base housing on an attachment element of the body rail, such that the movement mechanism can be mounted on the body rail of one of a left or a right guidance system for a push element.

2. The movement mechanism for a guidance system according to claim 1, wherein the attachment member is configured in mirror symmetry.

3. The movement mechanism for a guidance system according to claim 1, wherein the base housing is configured as an oblong housing element and wherein side walls of the base housing are present in mirror symmetry about a lengthwise axis of the base housing.

4. The movement mechanism for a guidance system according to claim 1, wherein two attachment members of the attachment means are present on opposite ends of the base housing in order to secure the movement mechanism by the attachment members to the body rail of the guidance system.

5. The movement mechanism for a guidance system according to claim 1, further comprises a housing cap, in addition to the base housing.

6. The movement mechanism for a guidance system according to claim 1, further comprises an ejector, a driver and a guide rail, wherein the ejector configured to be coupled to the driver of the guide rail and wherein the ejector is configured in mirror symmetry in order to work with either the left or the right guidance system for the push element.

7. The movement mechanism for a guidance system according to claim 1, further comprising an ejector, wherein the base housing comprises side walls, and at least a portion of the side walls of the base housing is configured to have elasticity, and the at least a portion of the side walls of the base housing is configured to snap the ejector onto the base housing.

8. The movement mechanism for a guidance system according to claim 7, wherein at least one side wall of the base housing has guide means in order to guide the ejector, in linear motion.

9. The movement mechanism for a guidance system according to claim 1, further comprising an ejector and a driver, wherein the ejector and the base housing are configured and the ejector is arranged on the base housing such that, in the mounted condition of movement mechanism on the guidance system, the driver of the guidance system runs across the ejector at least partly in a closing movement of the guidance system in order to couple with the ejector.

10. The movement mechanism for a guidance system according to claim 1, wherein a holding means is at least one of present and mounted at one of one end face and on one side wall of the base housing in the form of a holding member in order to mount at least one of an additional ejecting and retracting unit on the movement mechanism.

11. The movement mechanism for a guidance system according to claim 1, further comprising an ejector and a force accumulator, wherein the ejector is configured to connect the force accumulator to the movement mechanism.

12. The movement mechanism for a guidance system according to claim 1, wherein one of the movement mechanism is designed as one of an automatic retractor, as a touch latch unit and as an ejecting unit.

13. The movement mechanism for a guidance system according to claim 1, further comprising an ejector and a driver, wherein one of the base housing and side walls of the base housing are elastically configured so that in the mounted condition of the base housing on the guidance system a coupling of the ejector with the driver of the guidance system can be realized, and wherein the one of the base housing and one side wall of the base housing is bendable perpendicular to a lengthwise axis.

14. A guidance system unit which comprises a plurality of guide rail with the movement mechanism according to claim 1.

15. A push element guide unit with two guidance systems, wherein each guidance system comprises a plurality of guide rails, and wherein at least one of the guidance systems comprises the movement mechanism according to claim 1.

16. A piece of furniture or household appliance with the movement mechanism for a guidance system according to claim 1.

17. The movement mechanism for a guidance system according to claim 1, wherein the guidance system is a linear guidance system.

* * * * *